US007456827B2

(12) United States Patent
Rosmalen

(10) Patent No.: US 7,456,827 B2
(45) Date of Patent: Nov. 25, 2008

(54) ACTIVE MATRIX DISPLAY WITH VARIABLE DUTY CYCLE

(75) Inventor: Gerard Eduard Rosmalen, Mierlo (NL)

(73) Assignee: TPO Displays Corp., Chu-Nan (TW)

( * ) Notice: Subject to any disclaimer, the term of this patent is extended or adjusted under 35 U.S.C. 154(b) by 684 days.

(21) Appl. No.: 10/527,361

(22) PCT Filed: Aug. 8, 2003

(86) PCT No.: PCT/IB03/03569

§ 371 (c)(1),
(2), (4) Date: Mar. 10, 2005

(87) PCT Pub. No.: WO2004/025616

PCT Pub. Date: Mar. 25, 2004

(65) Prior Publication Data

US 2006/0012708 A1 Jan. 19, 2006

(30) Foreign Application Priority Data

Sep. 16, 2002 (EP) ..... 02078796

(51) Int. Cl.
*G09G 3/36* (2006.01)

(52) U.S. Cl. ..... 345/204; 345/87; 345/98; 345/212; 345/214; 315/169.1; 349/69

(58) Field of Classification Search ..... 345/55, 345/87, 89, 98, 212, 214, 215; 315/169.1; 349/69

See application file for complete search history.

(56) References Cited

U.S. PATENT DOCUMENTS

| | | | | |
|---|---|---|---|---|
| 5,052,777 | A * | 10/1991 | Ninnis et al. | 385/19 |
| 5,649,291 | A | 7/1997 | Tayloe | |
| 5,781,169 | A | 7/1998 | Kuijk et al. | |
| 5,936,596 | A * | 8/1999 | Yoshida et al. | 345/9 |
| 6,018,662 | A | 1/2000 | Periyalwar et al. | |
| 6,121,952 | A * | 9/2000 | Igari | 345/690 |
| 6,144,162 | A * | 11/2000 | Smith | 315/169.1 |
| 6,522,356 | B1 * | 2/2003 | Watanabe | 348/272 |
| 6,667,791 | B2 * | 12/2003 | Sanford et al. | 349/139 |
| 6,792,248 | B1 | 9/2004 | Naghian | |
| 2001/0015716 | A1 * | 8/2001 | Kim | 345/96 |
| 2001/0020925 | A1 * | 9/2001 | Hattori et al. | 345/87 |
| 2001/0052606 | A1 | 12/2001 | Sempel et al. | |
| 2002/0093495 | A1 * | 7/2002 | Akimoto et al. | 345/204 |
| 2003/0039267 | A1 | 2/2003 | Koo et al. | |
| 2003/0052614 | A1 * | 3/2003 | Howard | 315/169.1 |
| 2004/0162099 | A1 | 8/2004 | Chen et al. | |
| 2004/0192308 | A1 | 9/2004 | Lee et al. | |

FOREIGN PATENT DOCUMENTS

| | | |
|---|---|---|
| WO | WO 01/26087 A1 | 4/2001 |
| WO | WO 01/63587 A2 | 8/2001 |

OTHER PUBLICATIONS

Huiberts et al, Proceeding MRS fall 2001, 708.

* cited by examiner

*Primary Examiner*—Bipin Shalwala
*Assistant Examiner*—Vince E Kovalick
(74) *Attorney, Agent, or Firm*—Liu & Liu

(57) ABSTRACT

The invention relates to an active matrix display device (10) having a plurality of pixels (110). The pixels are grouped into pixel groups (R', G', B'). Each pixel group (R', G', B') is assigned a specific duty cycle, such that at least two pixel groups are assigned different duty cycles. The device furthermore comprises circuitry (54) for driving each pixel group (R', G', B') at its assigned duty cycle. The invention also relates to the driving of such display devices.

20 Claims, 5 Drawing Sheets

ACTIVE MATRIX DISPLAY WITH VARIABLE DUTY CYCLE

FIELD OF THE INVENTION

This invention relates to active matrix display devices and to methods for driving pixels in such display devices.

TECHNICAL BACKGROUND

Display devices employing electroluminescent, light-emitting, display elements are well known. The display elements may comprise organic thin film electroluminescent elements, using, for example, organic materials, or other light emitting diodes (LEDs), using traditional III-V semiconductor compounds.

Recent developments in organic electroluminescent materials, particularly polymer materials, have demonstrated their ability to be used practically for video display devices. These materials typically comprise one or more layers of an electroluminescent material, for example a semiconducting conjugated polymer, sandwiched between a pair of electrodes, one of which is transparent and the other is of a material suitable for injecting holes or electrons into the polymer layer. The polymer material can be fabricated using a chemical-vapour deposition (CVD) process, or simply by a spin coating technique using a solution of a soluble conjugated polymer.

The invention is concerned with active matrix display devices. In active matrix displays, addressing takes place completely behind the-electroluminescent elements. The front surface of the display is coated with a continuous electrode while the rear surface electrode is patterned into individual pixels and their pixel circuits. Thin film transistors (TFTs) act as switches and (current) driving elements for each pixel.

The switching TFT is addressed by a set of narrow multiplexed electrodes (gate lines and power lines) running along the gaps between pixels. A pixel is addressed by applying a voltage to a gate line that switches the TFT on and allows charge from the power line to flow on to the pixel circuit electrode, for example the gate of the drive TFT. This sets up a current through the pixel and turns it on. The brightness of the pixel is determined during the addressing, by the current generated by the drive TFT. An image is created as the addressing circuitry scans across the matrix. A picture frame thereby incorporates addressing, during which the brightness of the pixel is dictated, and a duty cycle, during which the pixel is driven by the power line and light is emitted. The length of a duty cycle is the ratio between the length of time the power line drives the pixel and the total length of the picture frame. Of course, the length of the picture frame depends directly on the update frequency of the display. The duty cycle can be given as a percent ratio, for example a 50% duty cycle means that the pixel is driven for half the time of each picture frame. Of course, it can also be given as an absolute value, i.e. the time length of the cycle. In the following, a long duty cycle refers to driving the pixel for a large part of the frame, whereas a short duty cycle refers to driving the pixel for a small part of the frame.

Examples of an active matrix electroluminescent display are described in EP-A-0653741 and EP-A-0717446. Unlike matrix liquid crystal display devices, in which the display elements are capacitive and therefore take virtually no current and allow a drive signal voltage to be stored on the capacitance for the whole frame period, the electroluminescent display elements need to continuously pass current to generate light.

A problem with known organic electroluminescent materials, particularly polymer materials, is that they exhibit poor stability and suffer ageing effects whereby the light output for a given drive current is reduced over a period of time of operation. While in certain applications such ageing effects may not be critical, the consequences in a pixelated display can be serious, as a viewer can easily perceive any slight variation in light output from pixels.

The lifetime problem for PLED has been treated in a multiplicity of patent applications, see for example U.S. Pat. No. 6,144,162 and WO 01/26087 A1, where the lifetime of the pixels is extended by compensating the degradation using an increased driving current during the duty cycle. However, those solutions do not really solve the underlying problem, which is the degradation of the pixels. They merely alleviate the symptoms of the problem, by adjusting the driving current.

SUMMARY OF THE INVENTION

Therefore, it is an object of the present invention to provide an active matrix electroluminescent display device in which the degradation problem is overcome at least to an extent. This is achieved by a display device in accordance with claim 1, and by a method for driving pixels in such a display in accordance with claim 12.

In Haskal et al, Proceedings Asia Display/IDW '01, 1411, 2001, and Huiberts et al, Proceeding MRS fall 2001, 708, it is established that the lifetime of polymer light emitting devices (PLED) used for passive matrix displays depends upon the manner in which the devices are driven. In particular, varying the multiplex ratio in passive matrix displays can cause an increase in the lifetime by a factor of three for some types of PLED devices. However, not all PLED materials show the same behavior: for a Green-Yellow poly(phenylene vinylene) (GY-PPV)polymer, a short duty cycle is found to decrease the degradation, whilst for red emitting polymers, a long duty cycle can be preferred.

The different degradation processes for different types of polymer pixels suggest that different polymers have different degradation mechanisms. As a consequence, it has been recognized that the total degradation of a display can be reduced if different duty cycles are available, which are optimized to minimize the degradation of each type of pixel. Unfortunately, in passive matrix devices there is no freedom to adjust the duty cycle since this is rigidly fixed to the multiplex ratio. However, it has been recognized that active matrix driving gives a potentially infinitely variable duty cycle, as one is able to differentiate between the addressing and the duty cycle of a pixel.

Thus, the invention is based upon the fact that the dominating degradation mechanisms can be determined, and that an active display can be configured to drive the pixels at their individually most optimal duty cycle. Therefore, the invention enhances the lifetime of a fall color active matrix polymer (organic) light emitting diode (AMP(O)LED) display by introducing a pixel dependent variable duty cycle to the display.

The degradation mechanisms for a pixel could depend on many different factors apart from the type of polymer used, for example the combination of a polymer and a filter, the temperature of the polymer or the age of the polymer. It is even possible that the momentary mechanisms depend on the total history of operation of the pixel regarding any combination of factors. The history of operation might, for example, depend on the age of the pixel group, the number of frame periods it has been driven or the temperature at which it has been driven. The history of operation gives the current level of degradation, which thus is one parameter affecting the dominating degradation mechanisms. The mechanisms of a pixel can for example be determined in an empirical test, resulting in a degradation table to be stored for the display device. The degradation table thus holds information regarding the optimal duty cycle in different operating conditions. For example, it can state the optimal duty cycle for a pixel, given the pixel temperature and the age of the pixel. By monitoring the temperature and the age of the pixel, the duty cycle can thus be adjusted according to the degradation table. In a less complex, but still very effective embodiment, the duty cycle is determined once and for all when designing the display. In such a case, there is no need for arrangements for adjusting the duty cycles continuously.

Normally, each pixel of a full color active matrix display device is capable of emitting three distinctly different colors, for example red, green and blue (an RGB display). This is achieved by the fact that each pixel comprises three differently colored subpixels, each subpixel being operable to emit a respective color. Every pixel can thus emit a different color by simply assigning each subpixel a different brightness, and thereby mixing the three colors appropriately. Of course, the invention also encompasses subpixels having different duty cycles. Therefore, when pixels are discussed in the following, it should be understood that the reasoning also can be applied to subpixels.

Furthermore it should be noted, that for example a Green-Yellow PPV polymer might be used either as a green light emitter, or as a yellow light emitter, using the same electroluminescent polymer, but filtering the emitted light differently. In such applications, the green emitter and the yellow emitter might have different dominating degradation mechanisms. Therefore, it might be advantageous to use different duty cycles not only for different polymers, but also for the same polymer in different color configurations. Correspondingly, in the following, when discussing different pixels, it should be understood that the difference does not necessarily have to lie in the polymer as such. Rather, it should be understood that the difference refers to different dominating degradation mechanisms.

The different duty cycles are generally associated with groups of pixels. It is furthermore assumed that the pixels in a group have similar degradation characteristics. In one preferred embodiment of the invention, pixels having similar characteristics are grouped together. For example, a RGB display would have three different groups, one for each color of subpixels. However, it is also possible for the groups to comprise only one pixel, in which case each pixel can be assigned a specific duty cycle. Of course, different groups could comprise different numbers of pixels.

Furthermore, different duty cycles may be used for reasons other than reducing the degradation. For example, even though the inventive method reduces the degradation, it does not eliminate it totally. Therefore, the duty cycle can be further adjusted to compensate for the degradation of the pixel. A pixel driven at a longer duty cycle will of course emit more light than a pixel driven at a shorter duty cycle, and in this way compensate for the degradation. However, adapting the duty cycle of each pixel group so as to reduce the degradation of the pixels is highly preferred.

The pixel groups can have either a static or a dynamic assignment of duty cycles. In case a static assignment is used, the duty cycle is determined once and for all, for example when assembling the display device. Thus, the same duty cycles are used during the entire lifetime of the display device. In case a dynamic assignment is used, the duty cycles are adjusted during the lifetime of the display device. For example, adjustments can be done to compensate for temperature changes in the pixels or for the history of operation of the display device.

Therefore, one aspect of the invention provides a method for driving pixels in an active matrix display device comprising the steps of: grouping the pixels in pixel groups; assigning a specific duty cycle to each pixel group; and driving each pixel at the separately adjusted duty cycle that is assigned to its group.

This method is highly advantageous compared to driving every pixel at the same duty cycle. It provides the possibility of adjusting the duty cycle of each pixel group separately, for example depending on the dominating degradation mechanism of the pixel group. It is to be understood that a pixel group can comprise any number of pixels. In one embodiment, for example, all the pixels are grouped in only three groups, whereas in another embodiment each group comprises only one pixel. Irrespective of the embodiment, the degradation of the pixels can be reduced substantially compared with a display device in which all the pixels are driven at the same duty cycle.

In one preferred embodiment, the grouping of pixels into pixel groups is such that pixels having operatively similar dominant degradation mechanisms are grouped into the same group. For example, the grouping can be done based on the type of pixel, i.e. the color it can emit during operation, the temperature of the pixel or the history of operation of the pixel. This embodiment provides a very advantageous solution. Since the grouping is such that each group comprises a plurality of pixels, the number of groups, and therefore the number of duty cycles, can be reduced substantially without seriously affecting the degradation of the pixels. Thus, a small number of duty cycles are enough for providing a substantial reduction of the degradation of the pixels.

In another preferred embodiment, the grouping is done based on the type of pixel, for example by grouping every pixel operable to emit the same color in the same group. In one embodiment, the pixels may be operable to emit red, green and blue, in which case the display is a so-called RGB-display. In this embodiment, every pixel operable to emit light of a particular color is assigned the same duty cycle. Since the type of pixel, i.e. the color the pixel can emit during operation, has a fundamental influence on the dominating degradation mechanism, this embodiment is a simple and effective way to reduce the degradation.

In still another preferred embodiment, the duty cycle assigned to a pixel depends on the temperature of the pixel. Thus, the duty cycle is assigned dynamically. The temperature can for example be measured continuously, and the duty cycle appropriately adjusted when the temperature passes some predetermined threshold value(s). Of course, the temperature can be measured on pixel level, pixel group level or on display level, the latter giving an average temperature of the pixel groups or the entire display.

In still another embodiment, the duty cycle assigned to each pixel depends on the history of operation of the corresponding pixel. The history of operation could, for example, be based upon the number of frame periods the pixel has been driven or the age of the pixel. Also the temperature could be included in the history.

Of course, any combination of the above embodiments is feasible. The fundamental idea is that the pixels can be arranged so as to be driven at different duty cycles, and that different pixels have different dominating degradation mechanisms. The factors that determine the dominating mechanism are not limited to the above parameters. The degradation process is very complex and depends on a plurality of factors. Any such factor can be taken into account when assigning duty cycles to the pixels.

In another aspect, the invention provides an active matrix display device having a plurality of pixels, in which the pixels are grouped in pixel groups, each pixel group being associated with a specific duty cycle, and in which means are provided for driving each pixel at its corresponding duty cycle. It should be understood that the pixel groups could comprise any number of pixels. In one embodiment they comprise only one pixel each, whereas in another embodiment there are only three pixel groups. In case there are only three pixel groups, each of them might comprise every pixel operative to emit a specific color, for example green, blue or red. Irrespective of the embodiment, this aspect provides a highly advantageous display device, in which the specific duty cycles can be adjusted so as to minimize the degradation of the pixels in the pixel groups.

In a preferred embodiment, the pixels are grouped in pixel groups according to a dominant degradation mechanism common to the pixels in each group. In this embodiment, the number of duty cycles can be reduced without affecting the degradation of the display device. In general, it is easier and less costly to design and manufacture a display having a smaller number of duty cycles. In particular, a display in which each group comprises only one pixel, resulting in as many potential duty cycles as there are pixels, the display is particularly difficult to design. However, this latter choice at the same time provides the best conditions for reducing the degradation of the pixels.

In a particularly preferred embodiment, the pixels are grouped into pixel groups according to the color they can emit during operation.

It is furthermore preferred that the specific duty cycle associated with each pixel group depends on the temperature of the pixels in the corresponding pixel group. This can be achieved in many different ways. For example, in case each group comprises only one pixel, the temperature can be measured on the pixel level and the duty cycle can be adjusted accordingly. In case the pixel groups comprise a plurality of pixels, an average measurement can be taken. However, the easiest way to implement temperature dependence is to measure the temperature on a display level, thus assuming that every pixel has about the same temperature.

Still another preferred principle on which the duty cycles can be based is the history of operation. The history of operation might, for example, depend on the age of a pixel group, the number of frame periods with which it has been driven or the temperature at which it has been driven. The parameters relating the history of operation can be stored in a memory device, and a preferred duty cycle can be computed at any time on the basis of the history. Another way to implement this embodiment is to diagnose the pixels continuously. This can be done by monitoring the electrical properties of the pixels (for example the voltage at a given current) or by monitoring the emitted light from the pixels when driven in some reference mode. Whichever way is chosen, the measurement can be used as an approximate measure of the current degradation level of the pixel.

In a preferred embodiment, the pixels are operative to emit a first, a second, and a third color, and are grouped accordingly in a first, second, and third pixel group. The colors might be, for example, red, green, and blue, in which case the display device is an RGB-display. In this embodiment, the number of groups is reduced to only three but the degradation reduction is still substantial.

The variable duty cycle could be implemented in a number of different ways. In one preferred embodiment, each pixel group is connected to a separate power circuit that is operable to drive and control the duty cycle of the pixels in the corresponding group. The power circuits, i.e. the power lines, can for example be controlled by transistor switches, which, in such a case, are operable to turn the power on and off for the pixels in the pixel group. In another preferred embodiment, each pixel group is provided with a separate cathode, which is operable to control the duty cycles of the corresponding pixels. In such a case, transistor switches similar to those in the previous embodiment can for example control the cathodes.

In a still further embodiment, the display device is operable to address pixel groups more than one time during each picture frame. The device can either be arranged to use double addressing, in which case it is arranged to first turn the pixels on and then turn the pixels off, or to divide each picture frame into different segments, thereby effectively increasing the update frequency of the corresponding pixel group with a factor and at the same time reducing the duty cycle. If the device is operable to address pixel groups more than one time in each picture frame, it is preferred that the device furthermore is arranged to address pixel groups with similar degradation mechanisms (i.e. colours) in separate addressing rows. By adjusting the timing of the addressing pulses, the duty cycle of the display can also be adjusted.

Clearly, the shorter the duty cycle, the higher the light output should be to achieve the perception of the required average light output. A shorter duty cycle however has the general advantages of reducing motion artifacts and increasing display uniformity.

The invention can for example be implemented in field emission displays. In one preferred embodiment, the invention is implemented in an organic electroluminescent PLED/OLED display.

BRIEF DESCRIPTION OF THE DRAWINGS

Further features and objects of the present invention will be appreciated when the following detailed description of some preferred embodiments thereof is read and understood. In the detailed description, reference is made to the accompanying drawings, in which.

DETAILED DESCRIPTION OF PREFERRED EMBODIMENTS

Figure 1:
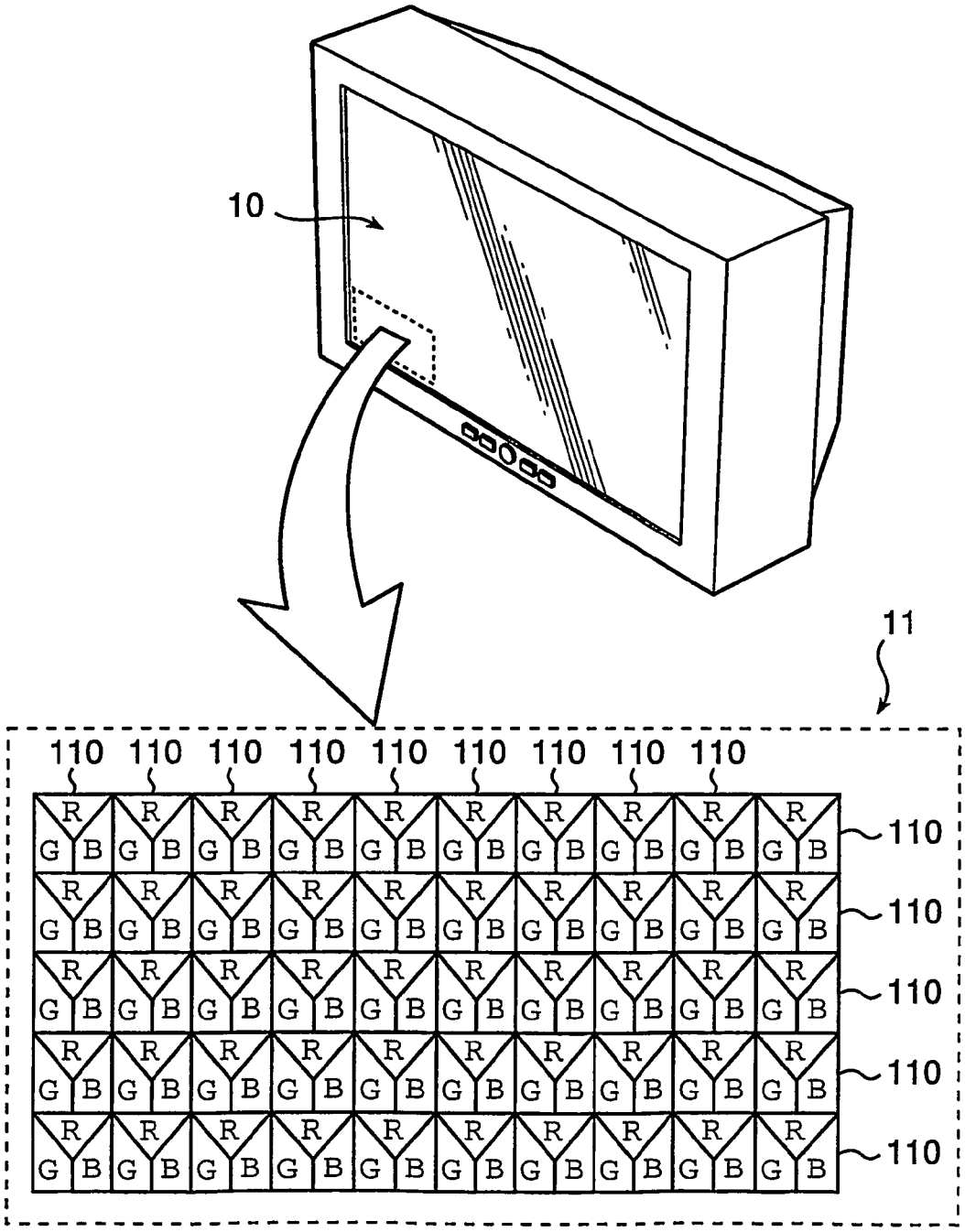
FIG. 1 schematically shows an active matrix display device, and an enlarged part of one corner of its display schematically disclosing a pixel matrix.
Figure 4:
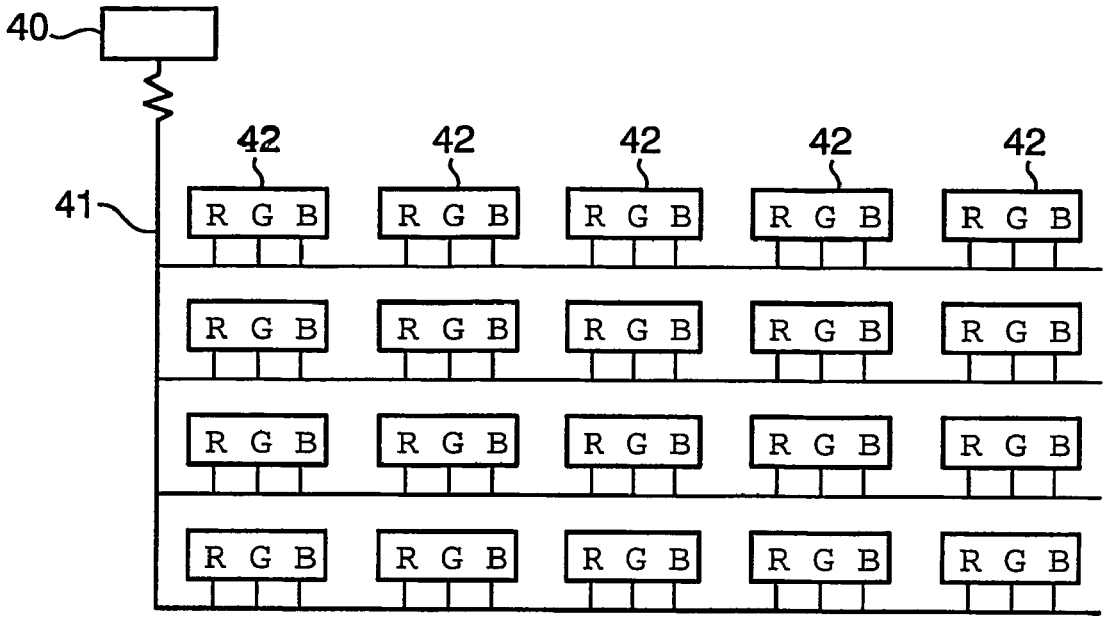
FIG. 4 schematically shows a power supply known per se for the pixels and power lines connecting the pixels to the power supply.

FIG. 1 schematically shows an active matrix RGB display device 10, and an enlarged part 11 of one corner of its screen. The display device 10 comprises a multiplicity of pixels 110. The pixels 110 comprised in the display device are RGB pixels, each comprising a red R, a blue B and a green G subpixel. Typically, when implementing the invention in a display device having multiple colored pixels 110, i.e. each pixel 110 has a number of subpixels R, G, B, the grouping of pixels is done such that each type of subpixel is grouped in the same pixel group R', G', B'. Thereby, each pixel is in a sense related to every pixel group, but each subpixel is only related to one pixel group. In a conventional display device, as schematically disclosed in FIG. 2, a row (or select) driver 21 and a column (or data) driver 22 are connected to, and address the subpixels 23 by, a row line 25 and a column line 24, respectively. Furthermore, as disclosed in FIG. 4, the pixels 42 (having subpixels R, G, B) are connected to a power supply 40, via power lines 41.

According to one aspect of the invention, an active matrix display device 10 is provided, having a plurality of pixels 110 grouped in pixel groups (R', G', B'). Each pixel group (R', G', B') is associated with a specific duty cycle, and circuitry 54, 21, 22; 31, 32 is provided for driving each pixel at its corresponding duty cycle. As will be discussed in the following, the circuitry 54, 21, 22; 31, 32 can be based on many different principles.

In a first preferred embodiment of the invention, it is assumed that the different subpixels R, G, B show a minimum degradation at different duty cycles. Thus, the subpixels are divided into pixels groups R', G', B'. This embodiment preferably refers to, for example, a RGB display 10, in which case the active matrix device 10 must be able to generate 3 different duty cycles, one for each of the colors.

Figure 2:
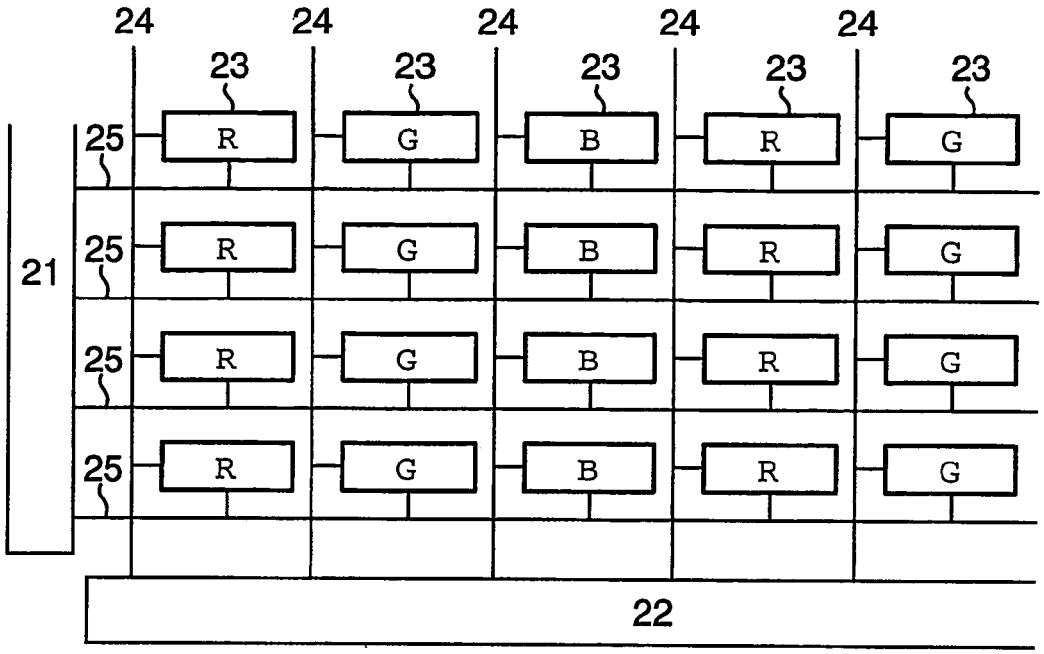
FIG. 2 schematically shows a drive circuitry that is known per se, in which each pixel is related to a row line and a column line.
Figure 5:
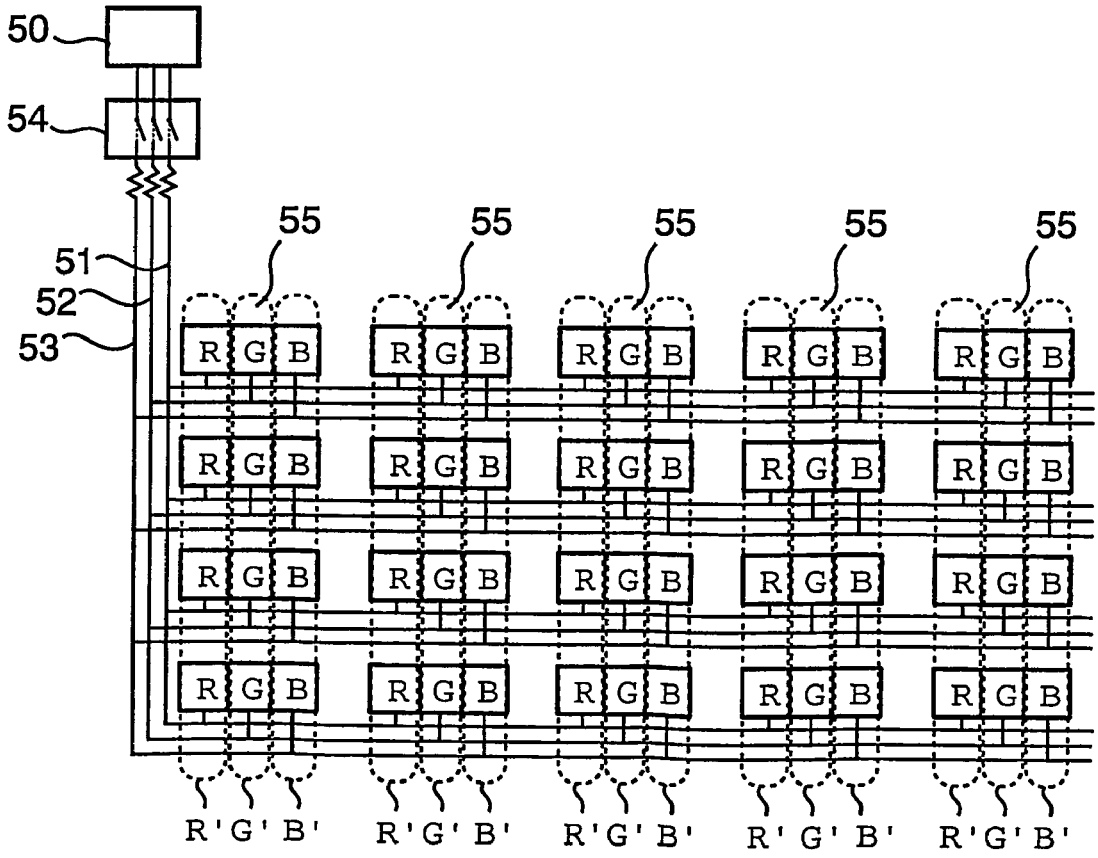
FIG. 5 schematically shows an inventive power line circuitry, operative to drive different pixel groups at different duty cycles.

A straightforward method to achieve this mode of operation is schematically disclosed in FIG. 5, which shows the power line circuitry, which should be added to the circuitry of FIG. 2. The pixels 55 each comprise a red R, green G, and blue B subpixel that are grouped into three pixel groups R', G', B'. In order to drive the pixel groups differently, 3 separate power lines 51, 52, 53 are introduced in the display, one for each pixel group. Three different duty cycles can then be achieved by making the power lines individually switchable, for example, by introducing power transistor switches 54 between power supplies 50 and the corresponding power lines 51, 52, 53. Thus, the means for providing different duty cycles is constituted by the transistor switches 54. In this embodiment, the row and column line circuitry can be of a conventional type, as disclosed in FIG. 2, where the pixels 23 are addressed by a common column driver 22 and a common row driver 21.

For colors requiring continuous operation, the power transistor switches 54 can be continuously connected. In a preferred embodiment, colors that require a continuous operation will not require a power switch, which will save costs.

For colors requiring longer duty cycles, preferably around 50% or higher, it may be necessary to subdivide the pixel groups and the power lines connected thereto into two or more subgroups, each subgroup having its own power switch. In this manner, the power can be connected to subgroups of a group whilst the other subgroup(s) is(are) being addressed.

Providing separate power lines 51, 52, 53 has the additional advantage of allowing different driving voltages to be applied in addition to different duty cycles. This can further optimize the operation of the display, for example by reducing the power needed. An alternative method to implement this mode of operation would be to provide separate cathodes for each color and provide these with individual power switches. However, a structured cathode is not the most preferred embodiment.

Figure 6:
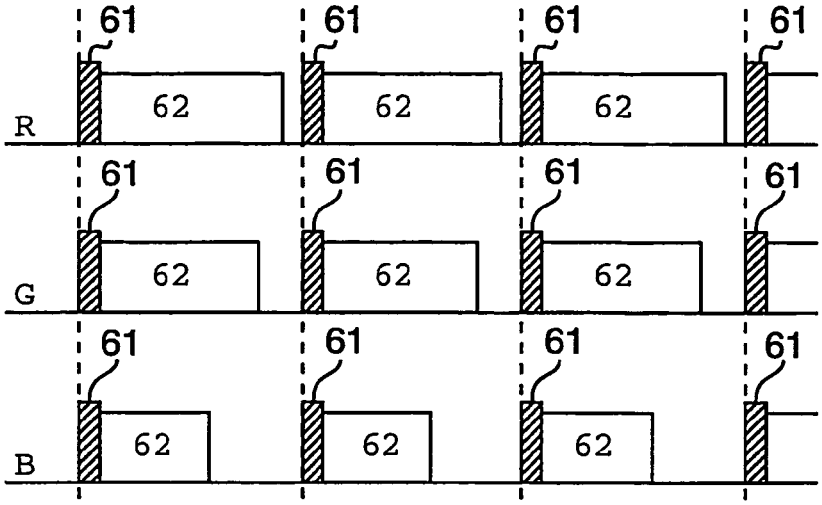
FIG. 6 schematically shows consecutive picture frames, in which the inventive power line disclosed in FIG. 5 controls the duty cycles.

If separate power lines 51, 52, 53 as well as separate cathodes are used, the pixel groups can be driven as schematically disclosed in FIG. 6. As can be seen, each duty cycle 62 in picture frame N is interrupted before the addressing 61 of picture frame N+1 takes place.

Figure 7:
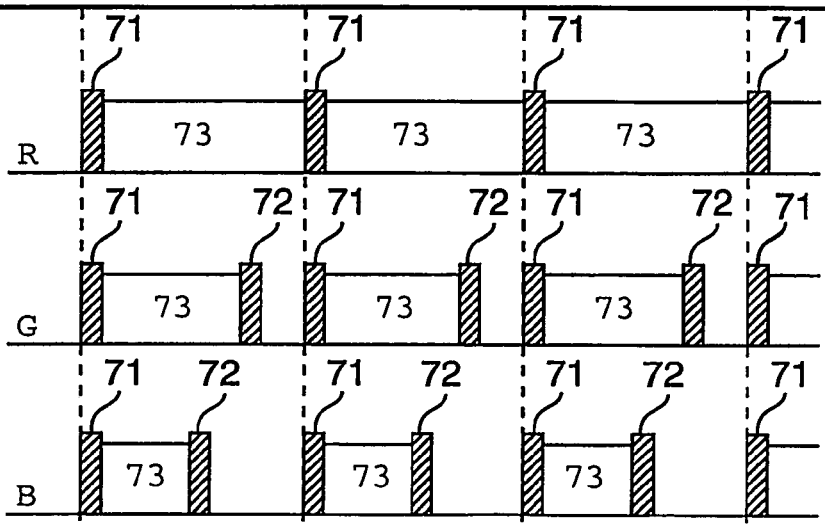
FIG. 7 schematically shows double addressing of pixel groups.
Figure 8:
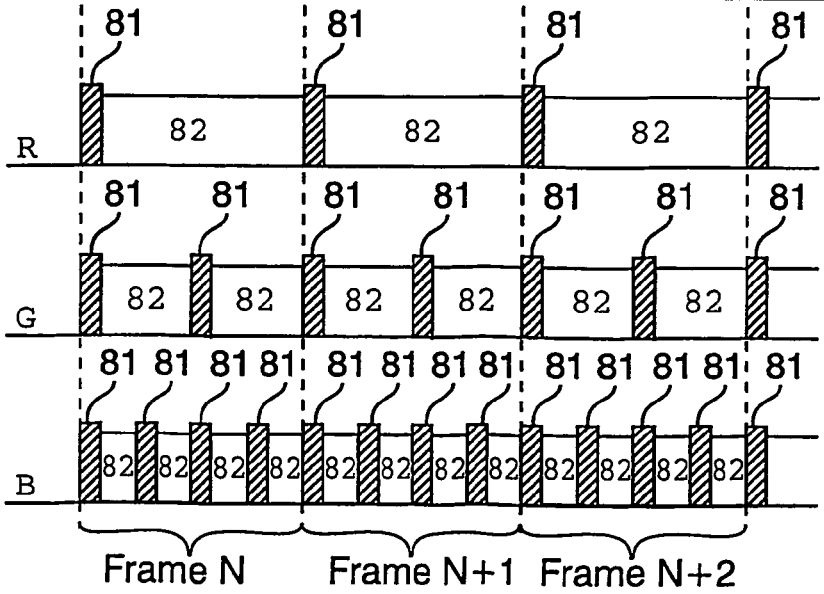
FIG. 8 schematically shows multiple addressing of pixel groups.

A still further method to implement this embodiment is to apply a double addressing of the pixels in each frame, as schematically disclosed in FIG. 7. That is, first turning the pixels on by addressing them with an on signal 71, thereafter driving them in a duty cycle 73, and finally turning them off by addressing them with an off signal 72. A disadvantage of this approach is that it becomes difficult to implement very short duty cycles, for example in the order of a few percent of a frame time, due to the fast addressing which will be required. Another way to implement the embodiment is disclosed in FIG. 8, where the picture frames are divided into a number of sub-frames and the pixel groups are addressed 81 in the beginning of each sub-frame and driven in duty cycles 82 having different lengths. In this way, the update frequency of the pixel groups is effectively increased with an integer factor and the duty cycles are reduced with the same integer factor. Thus, in this embodiment the circuitry for driving the pixels at different duty cycles is constituted by the row driver 21; 31 and the column driver 22; 32. Of course, the circuitry for driving the pixels might also be a separate unit, controlling the row driver 21; 31 and/or the column driver 22; 32.

Figure 3:
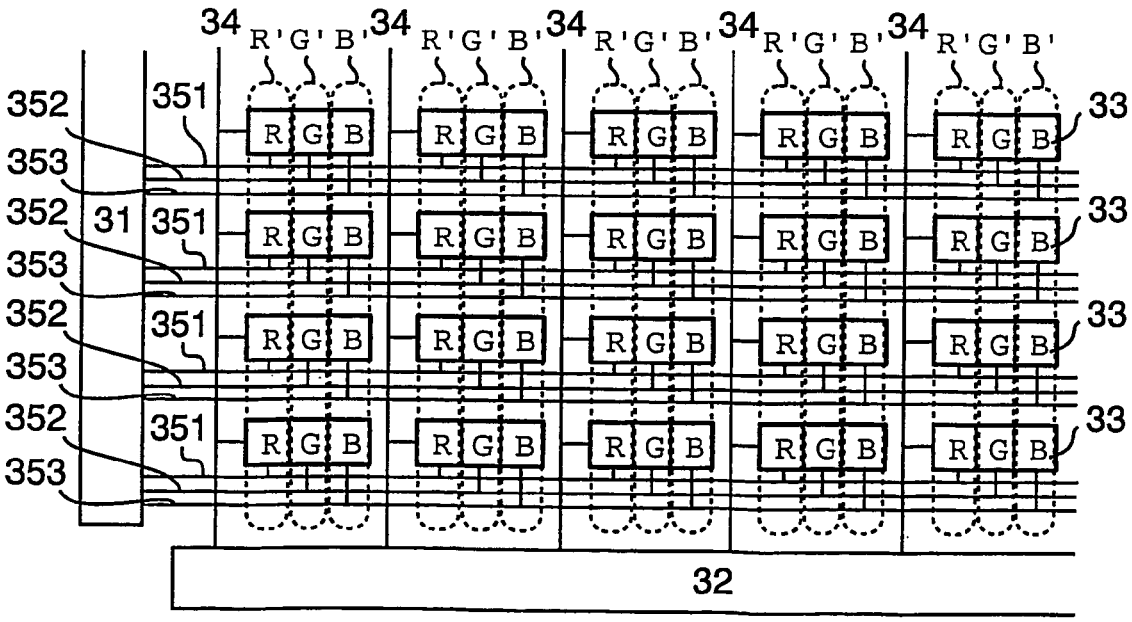
FIG. 3 schematically shows an inventive gate line circuitry, in which different pixel groups are addressed using different addressing rows.

In an alternative embodiment the display is arranged so that individual addressing rows 351, 352, 353 are attached to each pixel group, as schematically disclosed in FIG. 3. As can be seen, each pixel group R', G', B' is connected via separate addressing rows 351, 352, 353 to the row driver, but all the pixel groups in a column are connected via the same column lines 34 to the column driver 32. Of course, the row driver is adapted so as to be able to control the three different addressing rows 351, 352, 353 appropriately. This embodiment is opposed to the conventional type depicted in FIG. 2, where the three pixel groups R', G', B', e.g. the subpixel groups, all are attached to the same rows 25. In this inventive way, it is easy to ensure that all pixels of the same color receive the same duty cycle.

Figure 9:
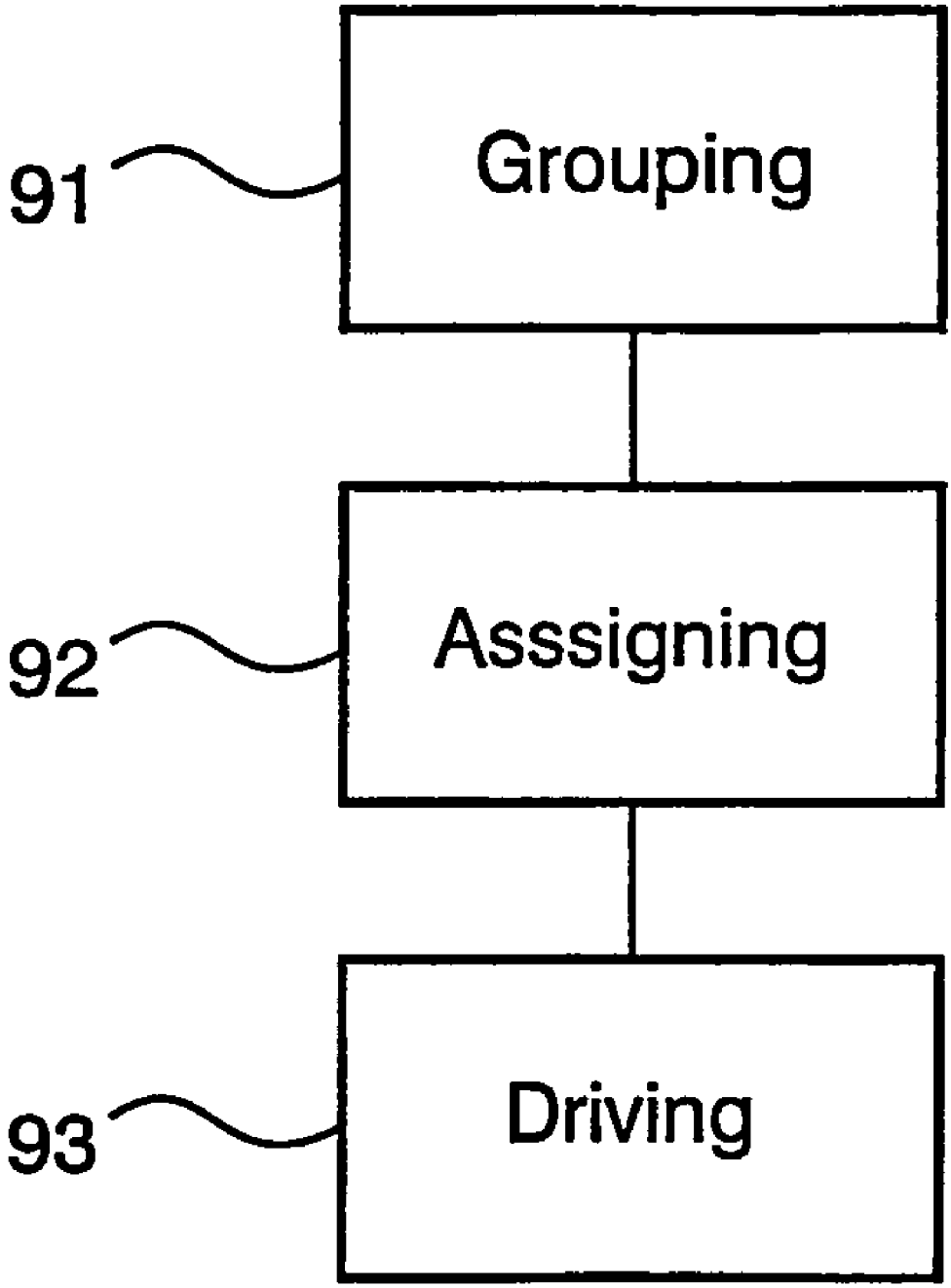
FIG. 9 shows a flowchart, which illustrates an inventive method for driving pixels.

According to another aspect of the invention, a method of driving pixels 110 in an active matrix display device 10 is provided. The flowchart in FIG. 9 schematically shows the inventive method, which comprises the steps of grouping 91 the pixels in pixel groups R', G', B', assigning 92 a specific duty cycle 62; 73; 82 to each pixel group R', G', B', and driving 93 each pixel 110 at the specific duty cycle 62; 73; 82 that is assigned to its pixel group R', G', B'. In one embodiment, the duty cycles 62; 73; 82 of each pixel group R', G', B' are fixed during display production, i.e. they are statically adjusted, in which case the steps of grouping 91 and assigning 92 are done once and for all during production. In another embodiment, the duty cycles 62; 73; 82 can be adjusted at the display level, i.e. they are dynamically adjustable. In the latter embodiment the grouping 91, the assigning 92 as well as the driving 93 are done continuously. Of course, it is also possible to combine static grouping 91 with dynamic assigning 92, i.e. the pixels are grouped once and for all, but the respective pixel groups R', G', B' are assigned different duty cycles 62; 73; 82 at different times.

Two situations can be considered in particular:

As the display temperature changes, the dominant degradation mechanism could change. In this case it might be preferable to alter the duty cycles for the different colored pixels. Adding a temperature sensor to the display and adjusting the duty cycles in the display controller according to the temperature is one way of implementing this approach.

As the display becomes older, the degradation mechanism could change, whereby it becomes preferable to alter the duty cycles for the different colored pixels. This could be implemented by determining the average usage of each group of colored pixels, for example by monitoring the integral of the data being applied to the display.

In displays having several individually adjustable groups, the above adjustments could be implemented within the individual groups.

In still another embodiment, the possibility to adjust the duty cycle 62; 73; 82 of individual colored pixels is assumed. Thus, each pixel group R', G', B' contains only one pixel. This may be preferred if the duty cycles 62; 73; 82 of different optimally functioning pixels change differently during their lifetimes. In this case, the step of assigning a duty cycle will comprise the steps of determining how old a pixel is, and then determining the optimum duty cycle for the pixel. It will then be necessary to adjust the duty cycle of individual pixels. This will for example be possible by dividing the frame into several sub-frames, according to FIG. 8, and implementing the duty cycle by igniting the pixel for only a subset of all available sub-frame periods, i.e. applying a form of pulse-width modulation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements, and by means of a suitably programmed computer. In the device claim enumerating several means, a number of these means can be embodied by one and the same item of hardware. The mere fact that certain measures are recited in mutually different dependent claims does not indicate that a combination of these measures cannot be used to advantage.

The invention claimed is:

1. An active matrix display device (10) having a plurality of pixels (110), wherein the pixels (110) are grouped into pixel groups (R', G', B'), according to a dominant degradation mechanism common to the pixels in each pixel group, and circuitry is present to drive each pixel group (R', G', B') at a specific duty cycle (62; 73; 82), wherein at least two pixel groups (R', G', B') are assigned different duty cycles.

2. An active matrix display device (10) according to claim 1, wherein the display device (10) is an organic electroluminescent display device.

3. An active matrix display device (10) according to claim 1, wherein the pixels (110) are grouped into pixel groups (R', G', B') according to the color they can emit during operation.

4. An active matrix display device (10) according to claim 1, wherein the specific duty cycle (62; 73; 82) assigned to each pixel group (R', G', B') depends on the temperature of the pixels (110) in the corresponding pixel group (R', G', B').

5. An active matrix display device (10) according to claim 1, wherein the specific duty cycle (62; 73; 82) assigned to each pixel group (R', G', B') depends on the history of operation of the corresponding pixel group (R', G', B').

6. An active matrix display device (10) according to claim 1, wherein the pixels (110) are operative to emit a first, a second and a third color, and are grouped into a first, a second, and a third pixel group (R', G', B') accordingly.

7. An active matrix display device (10) according to claim 6, wherein each pixel group (R', G', B') is connected to its own power circuit (51, 52, 53), which is arranged to generate and control the duty cycle (61) of the pixels in the corresponding pixel group (R', G', B').

8. An active matrix display device (10) according to claim 6, wherein each pixel group (R', G', B') is provided with a separate cathode, which is arranged to control the duty cycles (62; 73; 82) of the corresponding pixel group (110).

9. An active matrix display device (10) having a plurality of pixels (110), wherein the pixels (110) are grouped into pixel groups (R', G', B'), and circuitry is present to drive each pixel group (R', G', B') at a specific duty cycle (62; 73; 82), wherein at least two pixel groups (R', G', B') are assigned different duty cycles, and wherein the circuity is arranged to address (71, 72; 81) a pixel group (R', G', B') more than one time in each picture frame.

10. An active matrix display device (10) according to claim 9, arranged to address a pixel group (R', G', B') in separate addressing rows (351, 352, 353).

11. A method for driving pixels (110) in an active matrix display device (10) comprising the steps of:

grouping the pixels into pixel groups (R', G', B');

assigning a specific duty cycle (62; 73; 82) to each pixel group (R', G', B'), wherein the specific duty cycles (62; 73; 82) are adjusted so as to reduce the degradation of the pixel/pixels (110) in the corresponding pixel group (R', G', B'); and driving each pixel (110) at the specific duty cycle (62; 73; 82) that is assigned to its pixel group (R', G', B').

12. A method according to claim 11, wherein the grouping of pixels into pixel groups (R', B', G') is such that pixels (110) having operatively similar dominant degradation mechanisms are grouped into a same pixel group (R', G', B').

13. A method according to claim 11, wherein the assignment of a duty cycle (62; 73; 82) to each pixel group (R', G', B') is a static assignment, whereby the duty cycle (62; 73; 82) is the same for the entire lifetime of the display device (10).

14. A method according to claim 11, wherein the assignment of a duty cycle (62; 73; 82) to each pixel group is a dynamic assignment, whereby the duty cycle (62; 73; 82) changes during the lifetime of the display device (10).

15. An active matrix display device (10) according to claim 1, wherein the assignment of a duty cycle (62; 73; 82) to each pixel group (R', G', B') is a static assignment, whereby the duty cycle (62; 73; 82) is the seine for the entire lifetime of the display device (10).

16. A method according to claim 1, wherein the assignment of a duty cycle (62; 73; 82) to each pixel group is a dynamic assignment, whereby the duty cycle (62; 73; 82) changes during the lifetime of the display device (10).

17. A method according to claim 11, wherein a pixel group (R', G', B') is addressed (71, 72; 81) more than one time in each picture frame.

18. A method according to claim 11, wherein the pixels (110) are grouped into pixel groups (R', G', B') according to the color they can emit during operation.

19. A method according to claim 11, wherein the specific duty cycle (62; 73; 82) assigned to each pixel group (R', G', B') depends on the temperature of the pixels (110) in the corresponding pixel group (R', G', B').

20. A method according to claim 11, wherein the pixels (110) are operative to emit a first, a second and a third color, and are grouped into a first, a second, and a third pixel group (R', G', B') accordingly.

* * * * *